US006003167A

United States Patent [19]

Nehring

[11] Patent Number: 6,003,167

[45] Date of Patent: Dec. 21, 1999

[54] APPARATUS FOR ELIMINATING GAS FROM A FLUID PIPING SYSTEM

[76] Inventor: W. Wayne Nehring, 15802 Panarama Ct., Del Valle, Tex. 78617

[21] Appl. No.: 09/096,564

[22] Filed: Jun. 12, 1998

[51] Int. Cl.[6] ..... A47K 3/00

[52] U.S. Cl. ..... 4/541.1; 4/541.3; 4/541.4; 137/175; 417/435

[58] Field of Search ..... 4/541.4, 492, 541.1, 4/541.2, 541.3, 541.5, 541.6; 137/175, 176, 179, 180, 181, 197; 141/58; 417/435

[56] References Cited

U.S. PATENT DOCUMENTS

| | | | |
|---|---|---|---|
| 1,983,131 | 12/1934 | Hume | 103/13 |
| 1,997,418 | 4/1935 | Hornschuch et al. | 103/13 |
| 2,776,630 | 1/1957 | Fagan | 103/203 |
| 2,847,149 | 8/1958 | Ainsworth | 222/544 |
| 3,197,069 | 7/1965 | Brunson | 222/72 |
| 3,474,735 | 10/1969 | Gilmore | 103/113 |
| 3,575,521 | 4/1971 | Porter et al. | 415/27 |
| 3,586,040 | 6/1971 | Urback | 137/517 |
| 3,722,180 | 3/1973 | Boucher et al. | 95/254 |
| 3,741,675 | 6/1973 | Porter et al. | 415/11 |
| 4,255,079 | 3/1981 | Piegza | 415/11 |
| 4,602,391 | 7/1986 | Shepherd | 4/542 |
| 4,846,308 | 7/1989 | Sui | 184/6.23 |
| 5,137,061 | 8/1992 | Deininger et al. | 141/18 |
| 5,263,459 | 11/1993 | Talaski | 123/516 |

FOREIGN PATENT DOCUMENTS

| | | | |
|---|---|---|---|
| 6-154114 | 6/1994 | Japan | A47K 3/00 |

*Primary Examiner*—Henry J. Recla
*Assistant Examiner*—Peter deVore
*Attorney, Agent, or Firm*—Arnold White & Durkee

[57] ABSTRACT

A gas release apparatus for use with centrifugal pumps, and particularly for centrifugal pumps when used in conjunction with a fluid piping system such as hydrotherapy tubs, spas, and whirlpools.

11 Claims, 2 Drawing Sheets

APPARATUS FOR ELIMINATING GAS FROM A FLUID PIPING SYSTEM

BACKGROUND OF THE INVENTION

Gas trapped in the pump housing of a centrifugal pump impairs the efficiency of the pump, and may cause the pump to not work at all. In some circumstances, the pump may fail prematurely. To deal with these problems, there have been many attempts to remove gas from the pump housing of a centrifugal pump, either prior to startup, or during the startup phase. One straightforward solution has been to situate the pump in such a manner that the pump housing is filled with liquid after the outlet is covered, and before the pump is started. In some instances, however, this orientation of the pump may not be possible due to space constraints. Thus, the outlet of a pump may be lower than the top of the pump impeller; in this situation air may be trapped above the inlet pipe and in the suction and discharge chambers.

It is also recognized that gas may sometimes enter the pump chamber, as for example, if the suction head is lost between pumping cycles. In general, only after continuous operation of a pump will air or gas typically be purged from the pump housing, with resultant efficient pump operation. It is important, therefore, that air be purged from centrifugal pumps and other pumps that are susceptible to losing prime.

Before pump startup, both liquid and air are typically contained in the suction and discharge chambers of a centrifugal pump. When the pump motor is energized to start rotation of the impeller, a quantity of the liquid and gas from the suction chamber may be moved into the pump discharge chamber. This action creates a partial vacuum on the suction side of the pump. Atmospheric pressure exerted on the liquid to be pumped out of the suction chamber, coupled with the internal dimension of the inlet pipe, causes the fluid to rise into the inlet pipe. If the rotation of the impeller continues to move quantities of liquid and gas from the suction chamber into the discharge chamber, the height of the liquid in the pump chamber progressively increases. The priming cycle is completed when a vacuum has been established in the suction chamber, and the pump has been primed and is operating at its rated capacity and head, because most of the gas has been removed from the suction chamber. As noted above, however, there are instances when a pump may not prime and may eventually fail. Such is frequently the case, for example, in the operation of hydrotherapy tubs.

Hydrotherapy tubs typically have one or more jets which jet water against portions of a person who is occupying the tub. Water in the tub is circulated by means of a centrifugal pump from an exit near the bottom of the tub to a discharge line which leads to exit ports in one or more jets located in the tub. Water generally fills the tub to a point above the pump. The jet exit ports are generally located below the discharge or outlet connection of the pump. It is this vertical relationship between the exit ports and the outlet connection of the pump which causes air to be trapped in the pump and makes the pump difficult to prime.

In a hydrotherapy tub, the priming cycle of its pump begins while the tub reservoir is being filled. Water passes into the pump's piping system via the suction line of the pump, and rises above the elevation of the exit ports of the hydrotherapy jets. When the exit ports are covered with water, however, gas within the fluid piping system is unable to escape. As noted above, if the centrifugal pump is located above the level of the exit ports, or even if it is level with these ports, air will be trapped inside of the centrifugal pump making it difficult to prime.

In many cases of hydrotherapy tubs and in other instances as well, it may be impossible to locate the centrifugal pump below the surface of the exit ports. Thus, as will be apparent from the foregoing description it is necessary in this case to vent the air or other gas that is trapped in the pump housing in order to prime the pump. Otherwise, the air or gas prevents water from completely filling the pump housing, and the pump impeller cannot efficiently pump water into the discharge chamber even after the priming cycle. Pressure in the discharge chamber, therefore, remains relatively low. Unless the gas is completely vented, the pump is not able to develop sufficient head or operate at rated capacity.

SUMMARY OF THE INVENTION

The present invention addresses the above problems by means of a circulation system which is capable of continuously venting the pump discharge or downstream portion, including the pump casing, of the system. The system, which is especially useful in hydrotherapy tubs, comprises a special vent or bleed connection which enables air or other gas in the downstream portion of a circulation system to be vented directly or indirectly to the atmosphere. The connection typically includes a connector which has three parts—an inlet port and two outlet ports. The connector or fitting is located downstream and above the pump and the end of the line must be located in such a way that air escapes from the pump to facilitate priming. In most cases, this level of the air line is above the pump, and generally above the highest level of water in the tub. One port serves as the inlet for fluid discharged by the pump, and one serves as the outlet leading to the jets in the tub. The third port serves as an outlet for air or other gas. In one preferred embodiment this outlet discharges into an air or gas line conveying air or other gas from above the tub to the jet or jets in the tub for ejection by the jets into the tub. In another preferred embodiment the outlet is closed except for one or more openings which preferentially pass air over liquid.

In certain embodiments, the apparatus of the invention comprises a small tube or capillary that has a first end connected to the discharge side of the pump above the highest level of the pump, and a second end vented to the open atmosphere. When the tub is filled, water fills the conduits on the suction side of the pump. As the water continues to rise, the pump housing begins to fill. Air that would normally be trapped in the pump housing is vented through the capillary into the atmosphere, and the pump housing is filled with liquid. Thus, when the pump is started, a full flow of liquid is possible since the amount of air in the pump housing is reduced or eliminated. As the pump generates pressure, a tiny stream of water with or without air is passed out of the pump housing through the capillary and out into the atmosphere.

In another embodiment, the second end of the vent tube or capillary is vented into the tub at a point above the level of the pump. This arrangement allows water passing through the vent to exit back into the tub, without any water loss. In still another embodiment, the discharge end of the vent tube or capillary is vented into the air inlet pipe for the hydrotherapy jets. Because the vent tube will generally have a small diameter, the amount of liquid escaping into the hydrotherapy jet air inlet pipe is relatively minuscule compared to the volume of air that is ejected into the hydrotherapy jets due to the venturi effect created by the jets. In this embodiment, it will be noted that the vent tube or conduit becomes essentially a bypass for the discharge conduit connecting the pump discharge to the jets in the tub.

In yet further embodiments, the vent port on the three-way connector or fitting may connect to a relatively large diameter conduit, but the vent port or the conduit may have a flow restriction device inserted therein to restrict a large quantity of fluid from flowing through the conduit. The flow restriction device acts to vent air into the atmosphere as the pump is filled, yet it restricts the flow of liquid once the pump is operating. In preferred embodiments, the flow restriction device is a disk having an orifice or a plurality of orifices that enable only a small amount of liquid to pass through the device. Utilizing such a flow restriction device allows the use of standard plumbing to connect the pump chamber of the centrifugal pump to the atmosphere during priming and operation of the pump, without an appreciable loss of fluid as the pump operates. The flow restrictor also may be in the form of a mesh or screen that is placed inside of the vent tube. In all aspects, the skilled artisan will recognize that any device or operation that serves to vent air from the pump housing into the atmosphere is contemplated as part of the present invention.

In still further embodiments, a valve is placed in the vent line to regulate the flow of air and water out of the pump. In preferred embodiments, the valve is a needle valve. In other embodiments, the valve may be a throttling valve, a rotary valve, a slide valve, or a push valve. The skilled artisan will recognize that the type of valve chosen is related to a particular application and as such requires only routine experimentation. Moreover, the adjustment of such a valve to allow a thin stream of liquid or air to move through the bypass tube is also a matter of routine experimentation that may be accomplished by the skilled artisan.

The invention, and its objects and advantages, will become more apparent in the detailed description of the preferred embodiment presented.

BRIEF DESCRIPTION OF THE DRAWINGS

In the detailed description of a preferred embodiment of the invention presented below, reference is made to the accompanying drawings forming a part of this specification.

DESCRIPTION OF THE PREFERRED EMBODIMENTS

Figure 1:
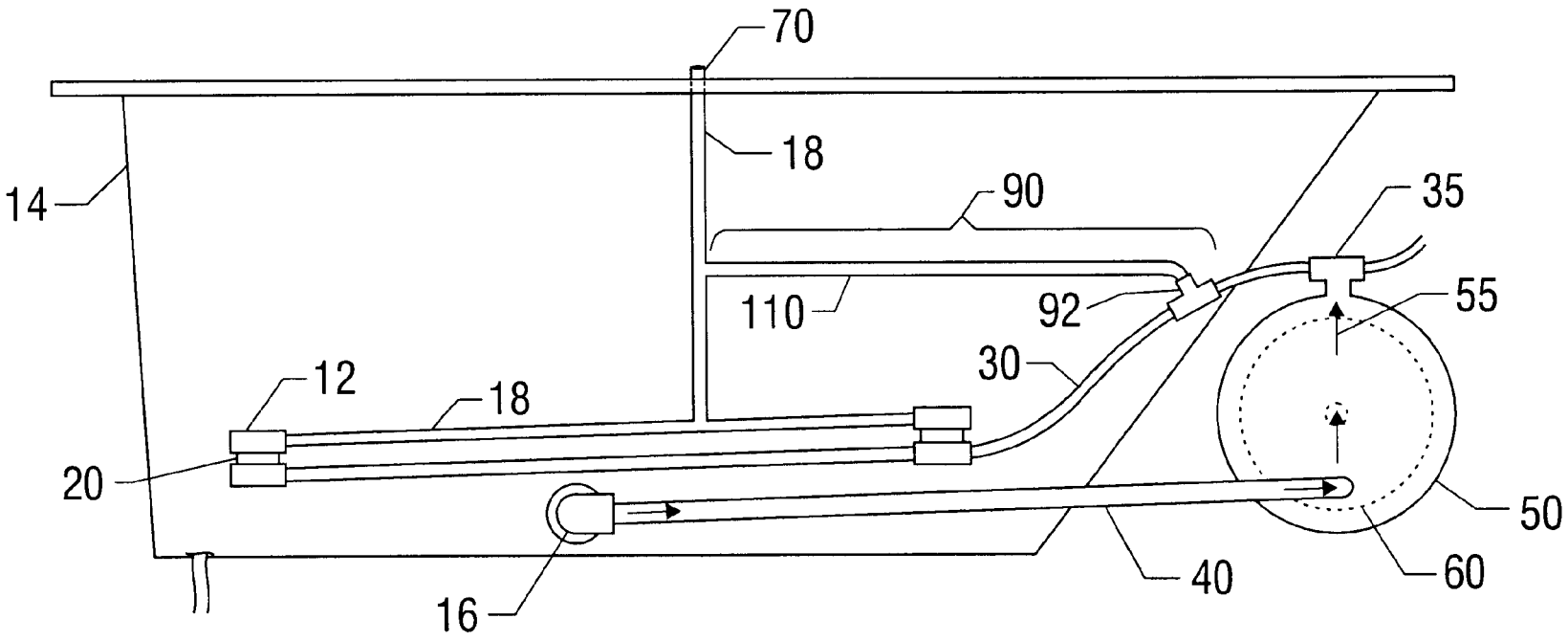
FIG 1 is a schematic diagram showing one form of the invention as applied to a drain-and-fill tub having a single suction fitting which feeds through a pump to a pair of hydrotherapy jets and a single outlet.

Shown in FIG. 1 is a drain-and-fill hydrotherapy tub 10 having at least one hydrotherapy jet 12 with an air line 18 and jet exits 20. While the invention may be applied to any fluid piping system, it is especially useful in connection with a tub of the kind which is drained and refilled each time it is used. The tub comprises reservoir 14, reservoir outlet 16 and at least one hydrotherapy jet 12. Each hydrotherapy jet 12 and the reservoir outlet 16 are connected via a feed line 40, a pump 50 and a water circulation line 30. The water circulation line 30 includes a pump discharge port 35. Liquid feed line 40 is positioned on the opposite side of centrifugal pump 50 from discharge port 35. Drain 25 in the bottom of the tub is to empty the contents when the user is finished using the tub.

An air inlet duct 70 that communicates with the atmosphere is connected to air line 18 to enable air to be mixed with the jet stream of water ejected from the hydrotherapy jets 12. Gas release or vent apparatus 90 connects the air inlet duct 70, the discharge line 30, and discharge port 35 together.

The system in FIG. 1 behaves in the following manner if gas release apparatus 90 is not in use during the simultaneous processes of filling the reservoir 14 and priming the centrifugal pump 50. Water and air are drawn into pump inlet chamber 60 from reservoir 14 through liquid feed line 40. When the water level in the reservoir 14 is below height of jet exits 20, the air is exhausted from the fluid piping system through jet exits 20 because of the pressure difference existing between the atmosphere and the pump discharge chamber 55. When the water level in reservoir 14 is equal to or greater than the height of jet exits 20, the air can not be exhausted since it is trapped in centrifugal pump 50, and centrifugal pump 50 has difficulty in forcing the water and air mixture through jet exits 20. Thus, the air is not eliminated from the piping system and centrifugal pump 50 airlocks.

With the gas release apparatus in place, the system behaves in the following manner during the simultaneous processes of filling the tub and priming centrifugal pump 50. Water and air are drawn into the pump inlet chamber 60 from the reservoir 14 through the liquid feed line 40. When the water level in reservoir 14 is below the height of jet exits 20, the air is exhausted from the fluid piping system via hydrotherapy jets 12 because of the pressure difference existing between the atmosphere and the pump discharge chamber. When the water level in the reservoir 14 is equal to or greater than height of the jet exits 20, gas release apparatus 90 provides means for air to be discharged from the fluid piping system via the bypass line 110 and value 108 which is connected to air inlet duct 70. The pressure in the air inlet duct 70 is approximately atmospheric pressure. The gas release apparatus 90 directs a small amount of the volume of the water from the discharge side of pump 50 through the gas release apparatus to hydrotherapy jets 12 via the air inlet duct 70 and the air line 18. This is generally not a problem, since the operation of hydrotherapy jets 12 accelerates the air in air inlet duct 70 causing the pressure in the air inlet duct 70 and the air line 18 to drop. Thus, the water released from the pump housing is ultimately sucked into the air line 18 and expelled into reservoir 14.

Figure 2B:
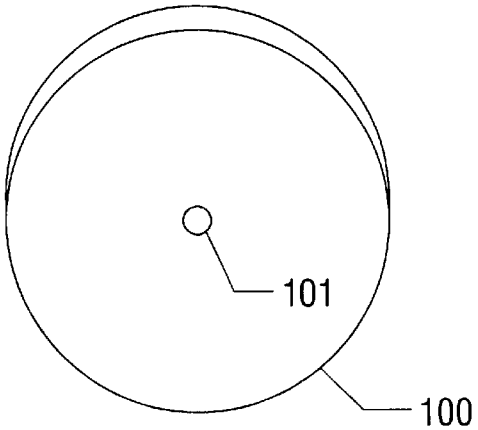
FIG. 2*b* is an enlarged view of one of the components of the invention as embodied in FIG. 2*a*.
Figure 2A:
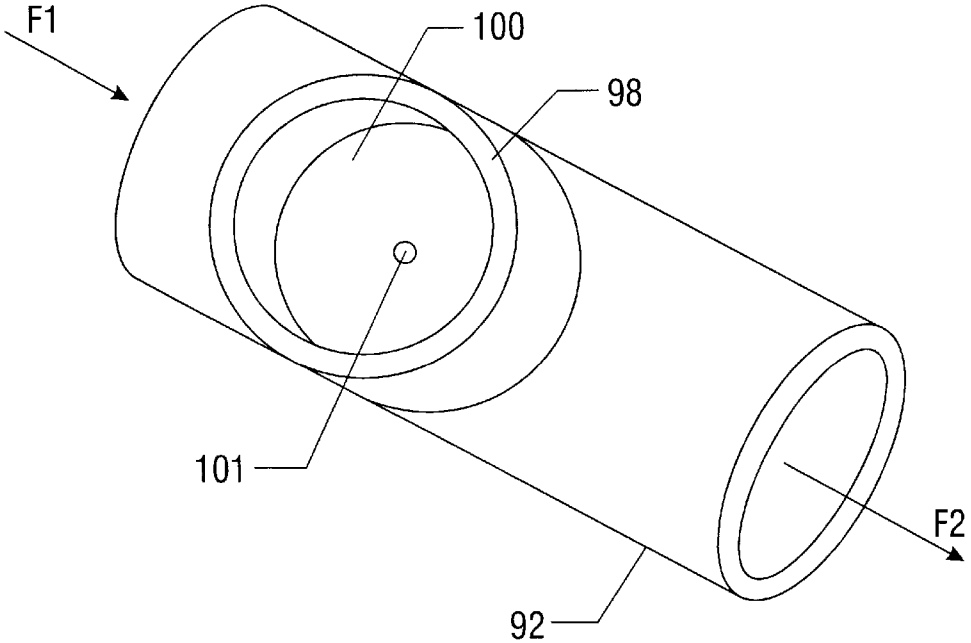
FIG. 2*a* is a perspective view of one embodiment of the gas release apparatus.

FIG. 2*a* and FIG. 2*b* show the details of gas release apparatus 90. FIG. 2*a* and FIG. 2*b* are partially schematic and indicate operative details only when necessary to impart an understandable description of the structure and operation of this invention. Details of construction have been eliminated wherever possible to simplify the description of this invention and facilitate an explanation of its basic features.

FIG. 2 shows one aspect of the invention as embodied as a T-connection 92 that connects three pipes in fluid communication. The T-connection has three ports; two of these ports are coaxial. Fluid enters into the connection in the direction indicated by F1 and exits the connection in the direction indicated by F2 Bypass line 110 (not shown) is connected to the non-coaxial port, herein called gas outlet 98. In other embodiments, it is recognized that certain plumbing arrangements may require bypass line 110 to be connected to any of the ports on T-connection 92. Thus, it may be necessary for water flow to flow through the tee as in an ell (or "L") connection. Straight through flow, however, is preferred.

The invention as embodied in FIG. 2*a* is further be comprised of the restriction device shown in FIG. 2*b*. The restriction device is disk 100 having an orifice 101 with a typical diameter from about 0.1 mm. to about 10 mm. Disk 100 is fastened into gas outlet 98, or it may be placed in any location inside of the bypass line 110.

Orifice 101 enables air to vent into the atmosphere while concurrently preventing most of the water from escaping the fluid piping system. It is important that the size of the orifice is such that the air can escape to the atmosphere without allowing any substantial quantity of liquid to flow to the atmosphere. It is recognized that too small of an orifice may unduly restrict air from escaping the fluid piping system and too large of an orifice may allow too large a quantity of water to escape from the fluid piping system. In certain embodiments, the diameter of the orifice is from about 1 mm. to about 6 mm. In other embodiments, the orifice diameter is from about 2 mm. to about 4 mm. The skilled artisan will recognize that the proper orifice diameter is easily determined from the teachings of the present application, since the orifice need be large enough only to provide a release for air pressure building in the pump housing.

It is recognized that the present invention may be manufactured out of a variety of materials, including plastic and metal. Moreover, certain embodiments may be produced by injection molding, extrusion, and the like.

It is also recognized that while certain embodiments depict the air bypass line operatively connected to the pump outlet port, it is also possible to connect the air bypass line to the pump housing or to other locations on the fluid discharge line, so long as the purpose of reducing or eliminating air from the pump housing is accomplished.

The apparatus disclosed and claimed herein may be made and executed without undue experimentation in light of the present disclosure. While the apparatus and methods of this invention have been described in terms of preferred embodiments, it will be apparent to those of skill in the art that variations may be applied to the apparatus and in the steps or in the sequence of steps of the method described herein without departing from the concept, spirit and scope of the invention. More specifically, it will be apparent that certain dimensions of the various components making the invention may be varied to achieve the same or similar results. While configurations depicted in the drawings indicate structures that are plumbed in a certain manner, the skilled artisan will recognize that the manner of operation of the invention does not require the plumbing or liquid flow or other structures to be precisely as set forth in the drawings. The manner of operation of the invention will not be significantly affected if these orientations are not precisely observed. Thus, all similar substitutes and modifications apparent to those skilled in the art are deemed to be within the spirit, scope and concept of the invention as defined by the appended claims.

What is claimed is:

1. Hydrotherapy apparatus comprising:

a tub configured to be filled with water and including a drain connection;

a jet positioned below the surface of the water when the tub is filled and operable to aspirate air into water flowing through the jet;

a centrifugal pump including an outlet positioned above the jet and an inlet;

a first conduit connecting the inlet of the pump to a water source;

a second conduit connecting the outlet of the pump to the jet;

a third conduit extending from the jet to above the surface of the water to enable air to be aspirated through the jet by water flowing from the pump through the jets; and a fourth conduit connected at a first end to a high point of the second conduit and adapted to bleed air and water from the second conduit continuously when the centrifugal pump is in operation.

2. Apparatus as defined in claim 1 wherein the fourth conduit is connected at a second end to the third conduit.

3. Apparatus as defined in claim 1 wherein the fourth conduit defines one or more passageways restricted for the flow of air in preference to water.

4. The apparatus of claim 1 wherein the fourth conduit includes a fluid restriction device located inside of a T-coupling having a disk with an orifice that is from about 0.1 mm. to about 10 mm. in diameter.

5. The apparatus of claim 4 wherein the orifice is from about 2 mm. to about 4 mm. in diameter.

6. The apparatus of claim 1 further comprising a valve operatively connected to the fourth conduit.

7. The apparatus of claim 6 wherein the valve is operatively connected to the pump outlet.

8. A system for reducing gas from liquid piping, the system comprising:

(a) a drain-and-fill reservoir for holding a quantity of liquid for hydrotherapy or bathing purposes having at least one reservoir outlet and at least one exit jet;

(b) a centrifugal pump with a pump inlet and a pump outlet at an elevation greater than the exit jet; and (c) a liquid piping system connecting the reservoir and the pump, the piping system comprising a suction line connecting the reservoir outlet and the pump inlet;

a discharge line connecting the pump outlet and the exit jet;

an air release apparatus connected to the discharge line between the pump outlet and the exit jet;

an air line having a first end connected to the air release apparatus, and a second end communicating with the atmosphere;

the air release apparatus comprises a T-coupling having a disk with an orifice that is from about 1 mm to about 6 mm in diameter mounted in the T-coupling so as to allow gas or liquid to pass through the orifice into the air line.

9. The air release apparatus of claim 8 wherein the reservoir is in the group consisting of hydrotherapy tubs, spas, and saunas.

10. The air release apparatus of claim 8 wherein the orifice is from about 2 mm. to 4 mm. in diameter.

11. The air release apparatus of claim 10 wherein a valve is located in the air line.

* * * * *